US008365453B2

(12) United States Patent
Goddard

(10) Patent No.: US 8,365,453 B2
(45) Date of Patent: Feb. 5, 2013

(54) FIREARM

(76) Inventor: Jeffrey D. Goddard, Port Saint Lucie, FL (US)

( * ) Notice: Subject to any disclaimer, the term of this patent is extended or adjusted under 35 U.S.C. 154(b) by 803 days.

(21) Appl. No.: 11/636,759

(22) Filed: Dec. 11, 2006

(65) Prior Publication Data

US 2010/0223831 A1 Sep. 9, 2010

Related U.S. Application Data

(63) Continuation-in-part of application No. 11/193,861, filed on Jul. 29, 2005.

(51) Int. Cl.
*F41A 21/00* (2006.01)

(52) U.S. Cl. ..... 42/7; 89/195; 102/446; 86/19.5

(58) Field of Classification Search ..... 102/464, 102/430, 439, 446; 86/19.5, 19.6; 89/194, 89/195; 42/7
See application file for complete search history.

(56) References Cited

U.S. PATENT DOCUMENTS

| | | | | | |
|---|---|---|---|---|---|
| 2,373,921 | A * | 4/1945 | Snell | 86/19.5 |
| 2,402,068 | A * | 6/1946 | Meador | 148/643 |
| 2,442,841 | A * | 6/1948 | Catlin et al. | 86/19.5 |
| 3,705,515 | A * | 12/1972 | Lee | 72/370.13 |
| 3,998,161 | A * | 12/1976 | Booth | 102/464 |
| 4,442,777 | A * | 4/1984 | Greene | 102/444 |
| 4,955,157 | A * | 9/1990 | Brighton et al. | 42/77 |
| 5,099,595 | A * | 3/1992 | Chesnut et al. | 42/50 |
| 5,287,720 | A * | 2/1994 | Lishness | 72/379.2 |
| 5,533,291 | A * | 7/1996 | Boland | 42/7 |
| 5,615,505 | A * | 4/1997 | Vaid | 42/50 |
| 6,055,758 | A * | 5/2000 | Vieweg | 42/7 |
| 6,094,850 | A * | 8/2000 | Villani | 42/1.02 |
| 6,293,203 | B1 * | 9/2001 | Alexander et al. | 102/430 |
| 7,011,028 | B1 * | 3/2006 | Emary | 102/464 |
| 2004/0074412 | A1 * | 4/2004 | Kightlinger | 102/430 |
| 2005/0229459 | A1 * | 10/2005 | McGarry | 42/7 |
| 2005/0257413 | A1 * | 11/2005 | Zimmermann | 42/75.1 |
| 2006/0248773 | A1 * | 11/2006 | Kightlinger | 42/77 |
| 2007/0022897 | A1 * | 2/2007 | Goddard | 102/464 |
| 2009/0211483 | A1 * | 8/2009 | Kramer | 102/439 |

* cited by examiner

*Primary Examiner* — Benjamin P Lee
(74) *Attorney, Agent, or Firm* — Steven McHugh

(57) ABSTRACT

A firearm for implementing an improved 9 mm cartridge is provided, wherein the improved 9 mm cartridge includes a 9 mm bullet associated with a 45-9 cartridge casing, wherein the 9 mm bullet weights at least 90 grains and wherein the 45-9 cartridge casing is configured to contain a propellant sufficient to propel the 9 mm bullet to a velocity of at least 1600 feet per second. The firearm may include a barrel, wherein the barrel is configured to operably interact with the 9 mm bullet and a chamber, wherein the chamber includes at least one chamber portion sized and shaped to operably associate with the 45-9 cartridge casing and a free-bore, wherein the free-bore includes at least one free-bore portion sized and shaped to operably associate with the 9 mm bullet.

9 Claims, 23 Drawing Sheets

Section Z - Z

FIREARM

RELATED APPLICATIONS

This application is a Continuation-In-Part of co-pending application Ser. No. 11/193,861 filed Jul. 29, 2005 entitled "Improved Firearm Cartridge", the contents of which is incorporated herein by reference in its entirety.

FIELD OF THE INVENTION

This disclosure relates generally to a firearm, and more particularly to a firearm for firing a modified 9 mm cartridge having a greater lethality.

BACKGROUND OF THE INVENTION

Since George Luger developed the P-08 9 mm Luger for the German Army in 1902, the nine millimeter (9 mm) cartridge has become one of the world's most popular and widely used firearm cartridges for pistols and submachine guns. In fact, in 1985, the United States Military adopted the M9 Baretta 9 mm pistol, which uses the 9 mm cartridge (M882), as its official sidearm. Referring to FIG. 1, as like most cartridges, the 9 mm cartridge 100 is typically comprised of a bullet 102 that is sealingly and snugly associated with a casing 104, wherein the casing 104 contains an explosive charge, such as gun powder 106 and a primer or cap 108 which is a small metal cup containing a detonating mixture 110 used to ignite the explosive power 106.

Referring to FIG. 2 and FIG. 3, a typical 9 mm firearm 112 is shown and includes a barrel 114 defining a muzzle opening 116 communicated with a chamber 118 via a barrel cavity 120. The firearm 112 also includes a magazine 122 for holding a plurality of cartridges 100 and a hammer 124 associated with a firing pin 128 which is further associated with the chamber 118. The hammer 124 is typically associated with a compression device 126 which when triggered causes the hammer 124 to interact with the firing pin 128 such that the firing pin 128 strikes the cap 108 of the cartridge 100 when the cartridge 100 is disposed within the chamber 118. As such, when the cartridge 100 is disposed within the chamber 118 of the firearm 112 and the compression device 126 is triggered, the firing pin 128 strikes the cap 108 of the cartridge 100 causing the cap 108 to detonate. This ignites the gun powder 106 within the casing 104 resulting in a rapid buildup of gas pressure between the bullet 102 and the casing 104. This pressure build up results in the bullet 102 being propelled at high velocity away from the casing 104, down the barrel 114 of the firearm 112 and out of the muzzle opening 116.

Although the popularity of the 9 mm firearm 112 and thus, the 9 mm cartridge 100, is due in large part to its reliability, the 9 mm firearm 112 has several disadvantages over larger caliber weapons. One such disadvantage involves the lethality of the 9 mm bullet 102 as compared with that of the .45 caliber bullet. Lethality, which is a reflection of the ability of a bullet to stop, or kill, an assailant, may be determined by the weight or mass of the bullet and its velocity at the point of impact. For example, a typical 9 mm cartridge 100 includes a bullet 102 weighing approximately 115-124 grains and holds enough explosive powder to propel the bullet 102 at a velocity of approximately 1150-1250 feet per second (fps) when fired. Unfortunately however, given this mass and velocity, the 9 mm bullet 102 does not achieve the desired level of lethality because the 9 mm bullet 102 does not have enough kinetic energy to impart against the human body. On the other hand, although the velocity of the .45 caliber bullet is slower than the 9 mm bullet 102, the .45 caliber bullet includes a much larger mass than the 9 mm bullet 102 and thus achieves a greater amount of kinetic energy than the 9 mm bullet 102. As such, when the .45 caliber bullet impacts a target, such as a human body, this greater amount of kinetic energy is transferred from the bullet to the soft tissue of the body allowing the .45 caliber bullet to achieve a higher lethality than the 9 mm bullet 102.

Unfortunately however, because of its relatively slow velocity, the .45 caliber bullet (and for that matter the 9 mm bullet 102) has a limited range and accuracy beyond thirty (30) yards. As such, this lack of accuracy typically causes a shooter to either expend numerous rounds to stop an adversary or to wait until the adversary is dangerously close before firing. This is undesirable because the shooter may either expend all of his/her ammunition or the shooter may be injured by letting the adversary to get dangerously close. Another disadvantage with the 9 mm bullet 102 and the .45 caliber bullet involves the currently achievable kinetic energy levels of these bullets. This is because at the currently achievable energy levels, the 9 mm bullet 102 and the .45 caliber bullet do not have the ability to penetrate the soft body armor currently used by our adversaries. Thus, the body armor tends to increase the likelihood that an adversary will survive a military engagement with allied armies. This is an undesirable situation because it may provide the adversary with additional opportunities to cause damage and harm to allied armies and/or citizens.

SUMMARY OF THE INVENTION

A firearm for implementing an improved 9 mm cartridge is provided, wherein the improved 9 mm cartridge includes a 9 mm bullet associated with a 45-9 cartridge casing, wherein the 9 mm bullet weights at least 90 grains and wherein the 45-9 cartridge casing is configured to contain a propellant sufficient to propel the 9 mm bullet to a velocity of at least 1600 feet per second. The firearm includes a barrel that is configured to operably interact with the 9 mm bullet, a chamber that includes at least one chamber portion sized and shaped to operably associate with the 45-9 cartridge casing and a free-bore, wherein the free-bore includes at least one free-bore portion sized and shaped to operably associate with the 9 mm bullet.

A method for modifying a firearm to operably associate with a 45-9 cartridge is provided. The 45-9 cartridge includes a 9 mm bullet associated with a 45-9 cartridge casing, wherein the 9 mm bullet weights at least 90 grains and wherein the 45-9 cartridge casing is configured to propel the 9 mm bullet to a velocity of at least 1600 feet per second. The method includes obtaining a firearm having a first barrel, wherein the first barrel includes a first barrel threaded portion, a first barrel free-bore portion and a first barrel chamber portion, each of which is configured to operably associate with a .45 caliber cartridge. The method further includes replacing the first barrel with an improved barrel, wherein the improved barrel includes an improved barrel portion, an improved barrel free-bore portion and an improved barrel chamber portion, each of which is configured to operably associate with the 45-9 cartridge.

A method for modifying a firearm to operably associate with a 45-9 cartridge, wherein the 45-9 cartridge includes a 9 mm bullet associated with a 45-9 cartridge casing, wherein the 9 mm bullet weights at least 90 grains and wherein the 45-9 cartridge casing is configured to propel the 9 mm bullet to a velocity of at least 1600 feet per second, the method including obtaining a firearm having a first barrel, wherein the first barrel includes a first barrel threaded portion, a first barrel free-bore portion and a first barrel chamber portion and replacing the first barrel with an improved barrel, wherein the improved barrel includes an improved barrel threaded portion, an improved barrel free-bore portion and an improved barrel chamber portion, each of which is configured to operably associate with the 45-9 cartridge.

BRIEF DESCRIPTION OF THE DRAWINGS

The foregoing and other features and advantages of the present invention should be more fully understood from the following detailed description of illustrative embodiments taken in conjunction with the accompanying Figures in which like elements are numbered alike in the several Figures.

DETAILED DESCRIPTION

Figure 1:
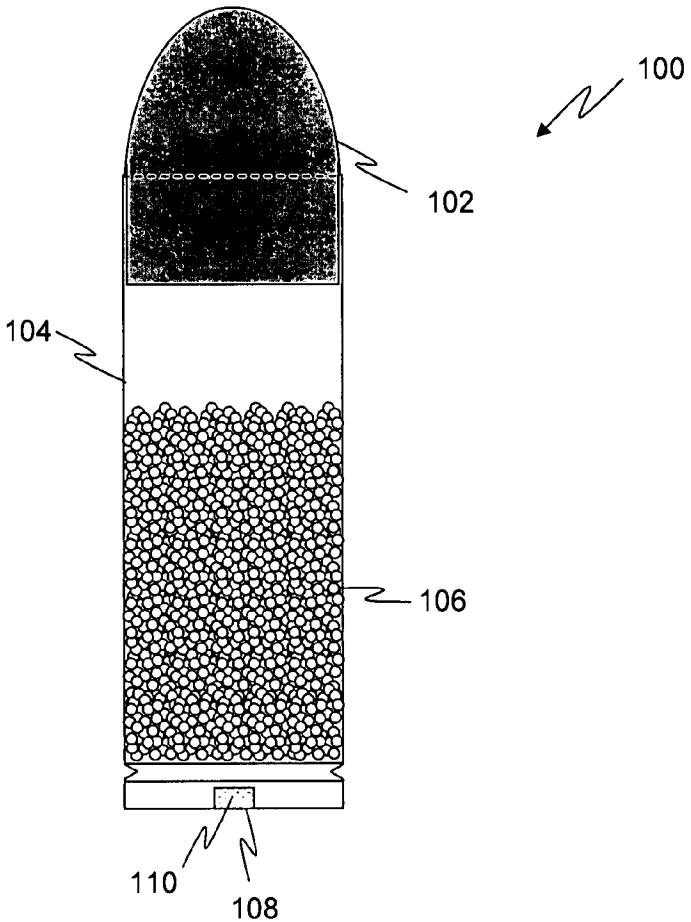
Figure 1 PRIOR ART
FIG. 1 is a sectional side view of a 9 mm cartridge in accordance with the prior art.
Figure 2:
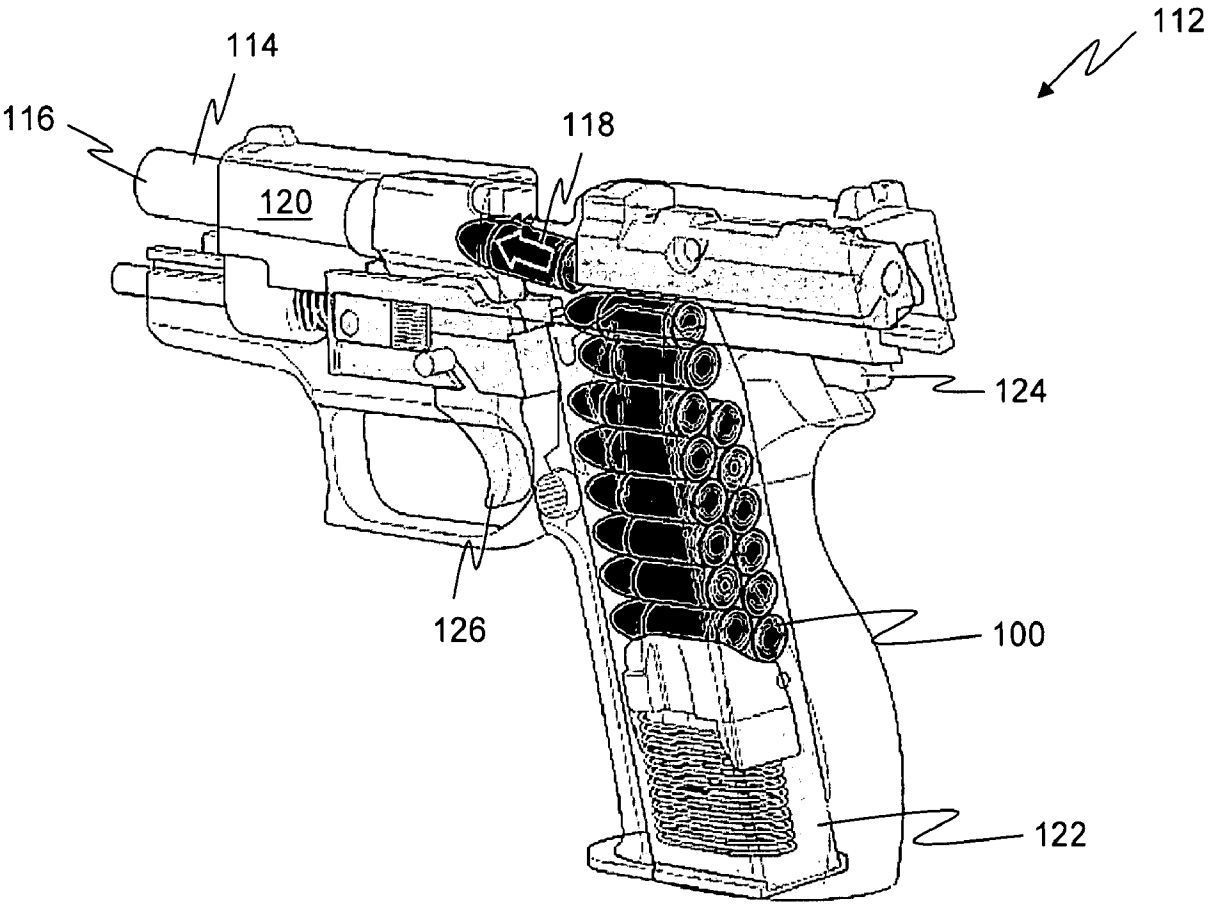
Figure 2 PRIOR ART
FIG. 2 is a side cross sectional perspective view of a 9 mm firearm employing the 9 mm cartridge of FIG. 1, in accordance with the prior art.
Figure 3:
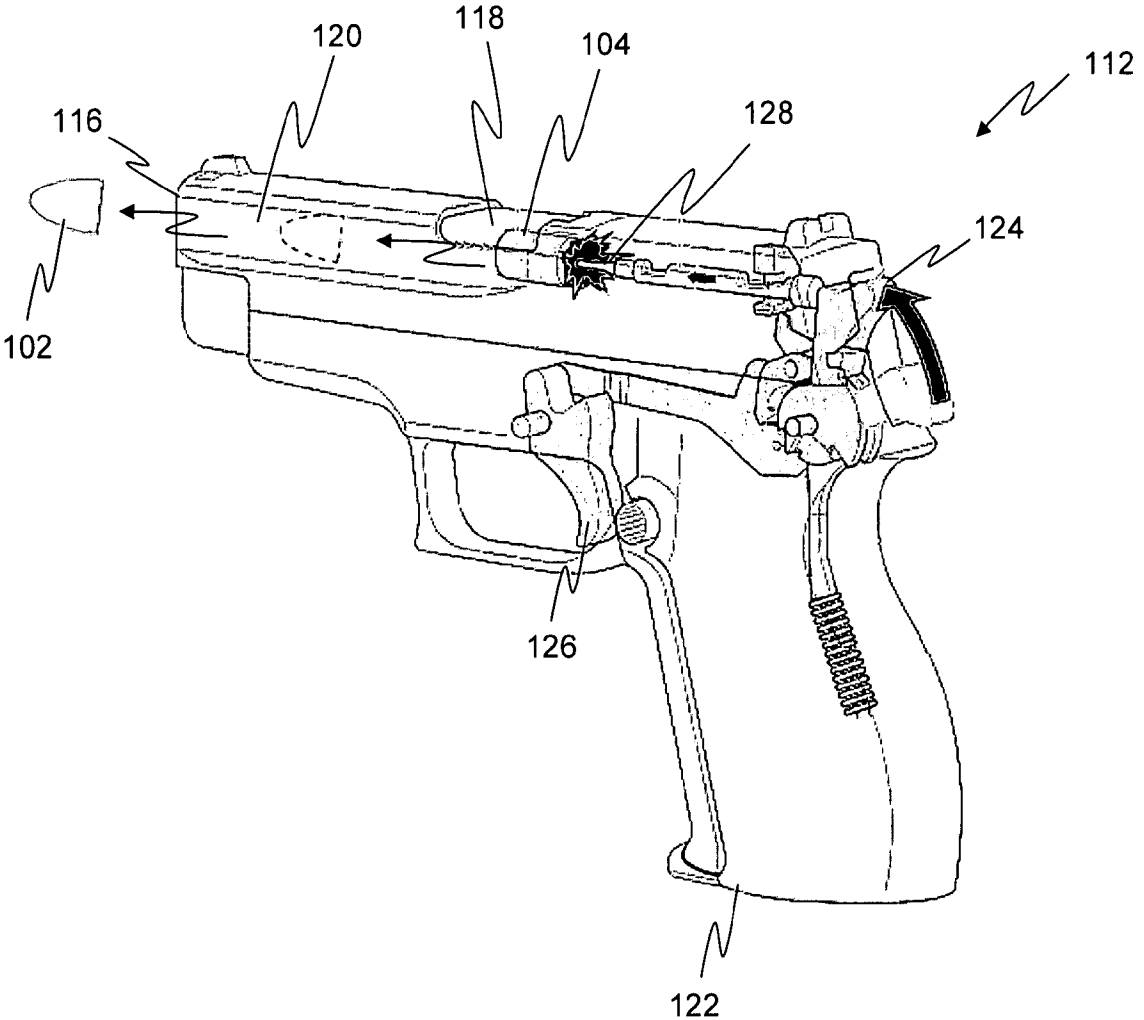
Figure 3 PRIOR ART
FIG. 3 is a side cross sectional perspective view of a 9 mm firearm employing the 9 mm cartridge of FIG. 1, in accordance with the prior art.
Figure 4:
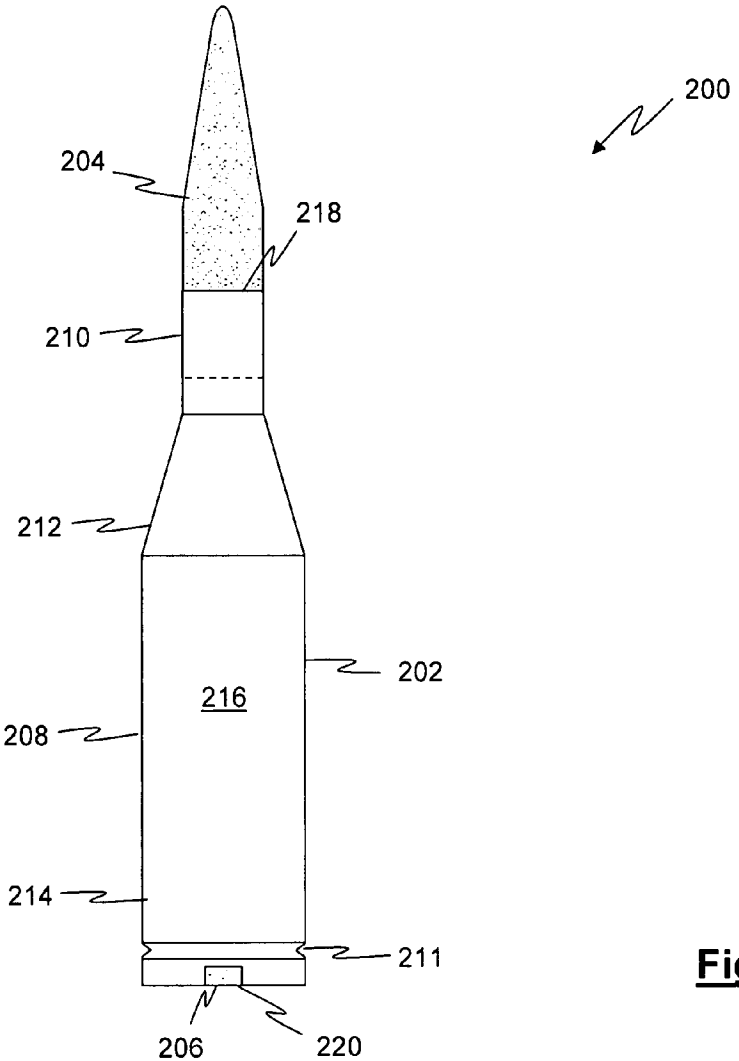
FIG. 4 is a side view of an improved 9 mm cartridge, in accordance with an exemplary embodiment.
Figure 5:
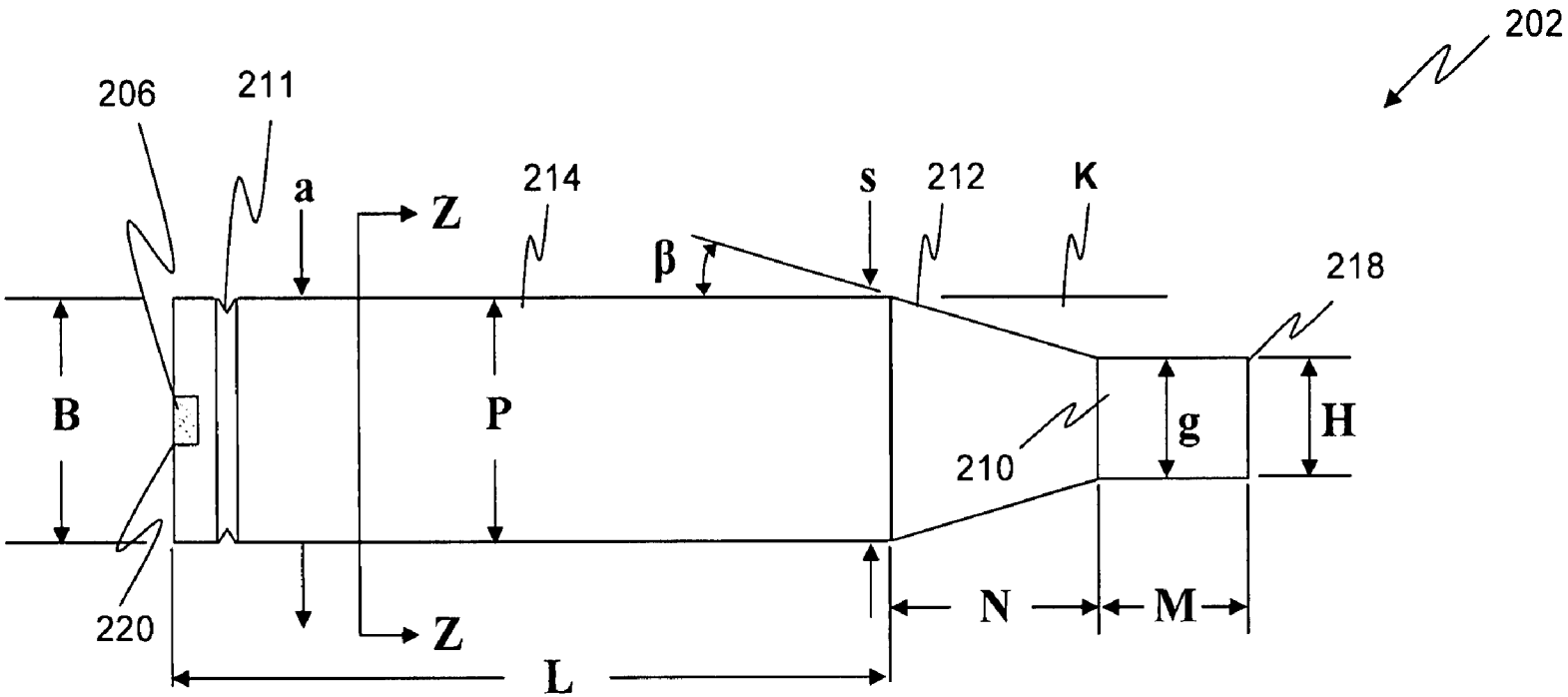
FIG. 5 is a side view of a cartridge case for the improved 9 mm cartridge in FIG. 4.

Referring to FIG. 4, a first embodiment of an improved 9 mm cartridge 200, hereinafter referred to as a 45-9 cartridge, is shown and includes a cartridge case 202, a bullet 204 and a primer or cap 206. The cartridge case 202 includes a casing structure 208 having a casing top portion 210, a casing center portion 212 and a casing bottom portion 214, wherein the casing structure 208 defines a casing cavity 216 such that the casing top portion 210 is communicated with the casing bottom portion 214 via the casing cavity 216. The casing top portion 210 defines a top opening 218 and the casing bottom portion 214 defines a bottom opening 220, wherein the top opening 218 is communicated with the bottom opening 220 via the casing cavity 216 and wherein the bottom opening is sized and shaped to securingly contain the cap 206. As shown in FIG. 5, the casing bottom portion 214 may also include an extractor interface portion 211 for interfacing with the ejector of a firearm and a casing bottom portion length L which may be approximately equal to 0.7480 inches. The casing bottom portion 214 also includes a first casing bottom portion diameter a disposed adjacent the cap 206 which may be approximately equal to 0.4738 inches and a second casing bottom portion diameter s disposed adjacent the casing center portion 212 which may be approximately equal to 0.4640 inches, wherein the casing bottom portion 214 is tapered between the first casing bottom portion diameter a and the second casing bottom portion diameter s.

Figure 6:
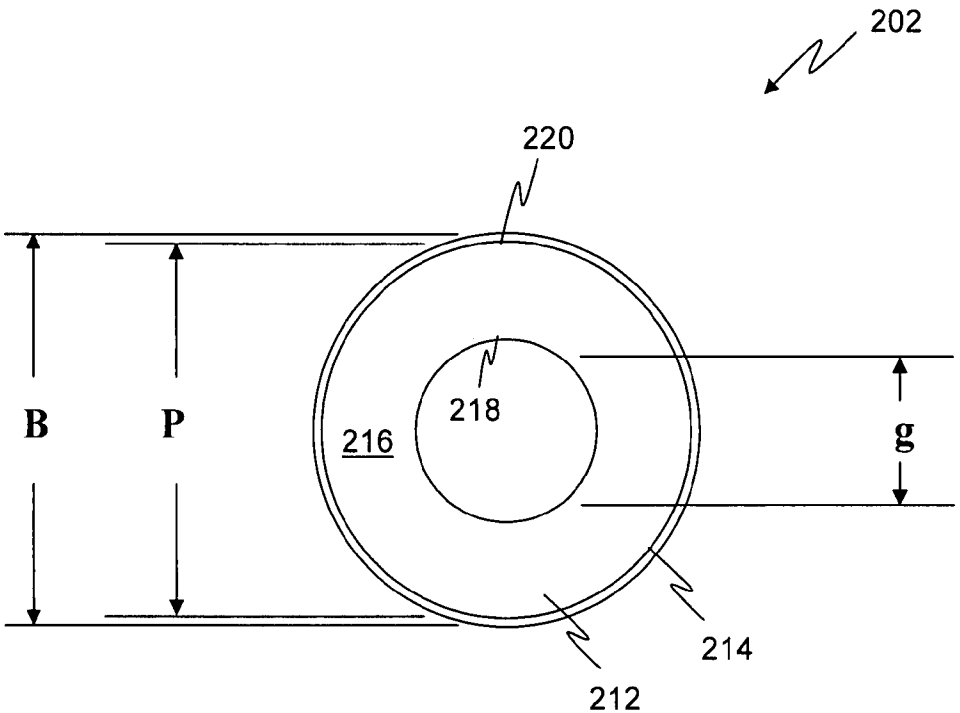
FIG. 6 is a bottom up view of the interior of the cartridge case for the improved 9 mm cartridge in FIG. 4.

The casing top portion 210 includes a casing top portion length M which may be approximately equal to 0.1285 inches, a casing top portion inner diameter g which may be approximately equal to 0.3550 inches and a casing top portion outer diameter H which may be approximately equal to 0.3810 inches, wherein the casing bottom portion 214 is separated from the casing top portion 210 by the casing center portion 212. The casing center portion 212 includes a casing center portion length N which may be approximately equal to 0.0236 inches and which may be tapered at an angle β relative to a plane K disposed parallel to the casing bottom portion 214, wherein β may be approximately equal to 20°. Additionally, referring to FIG. 6, the casing bottom portion 214 also includes a casing cavity diameter P, which traverses the casing bottom portion length L and which is sized and shaped to contain an amount of propellant sufficient to propel the bullet 204 at a velocity of at least 1600 feet per second. It should be appreciated that the case cavity diameter P may be uniformly sized or may be varied in size as desired, such as with a taper.

Figure 7:
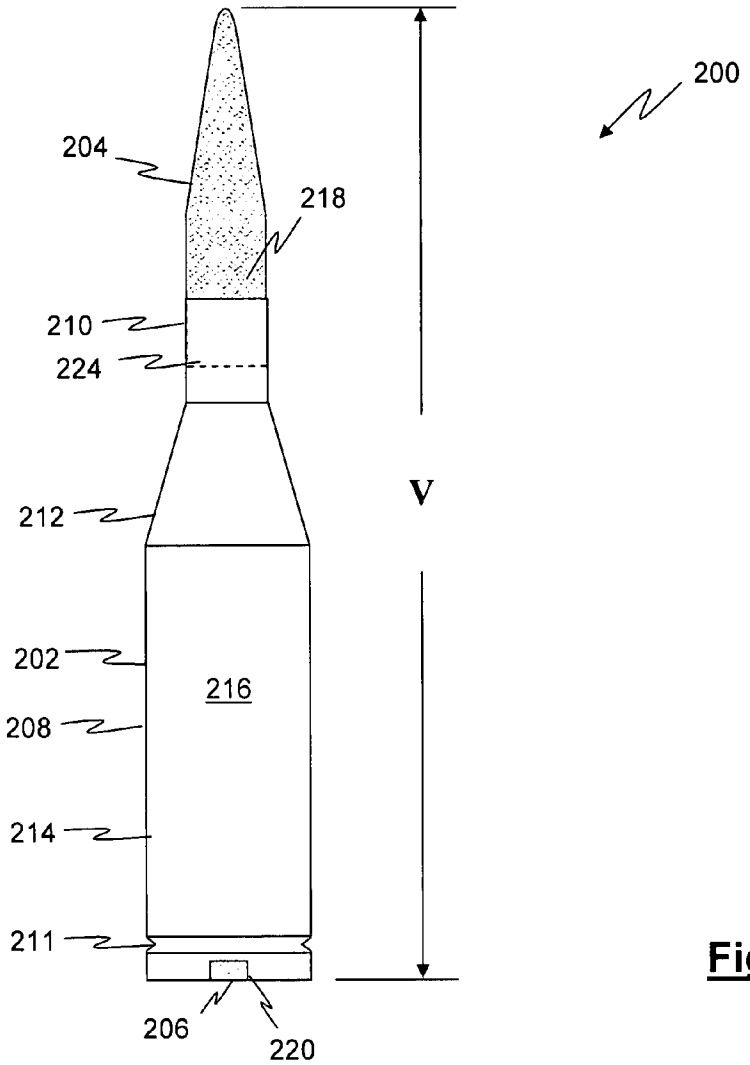
FIG. 7 is a side view of the improved 9 mm cartridge in FIG. 4.
Figure 8:
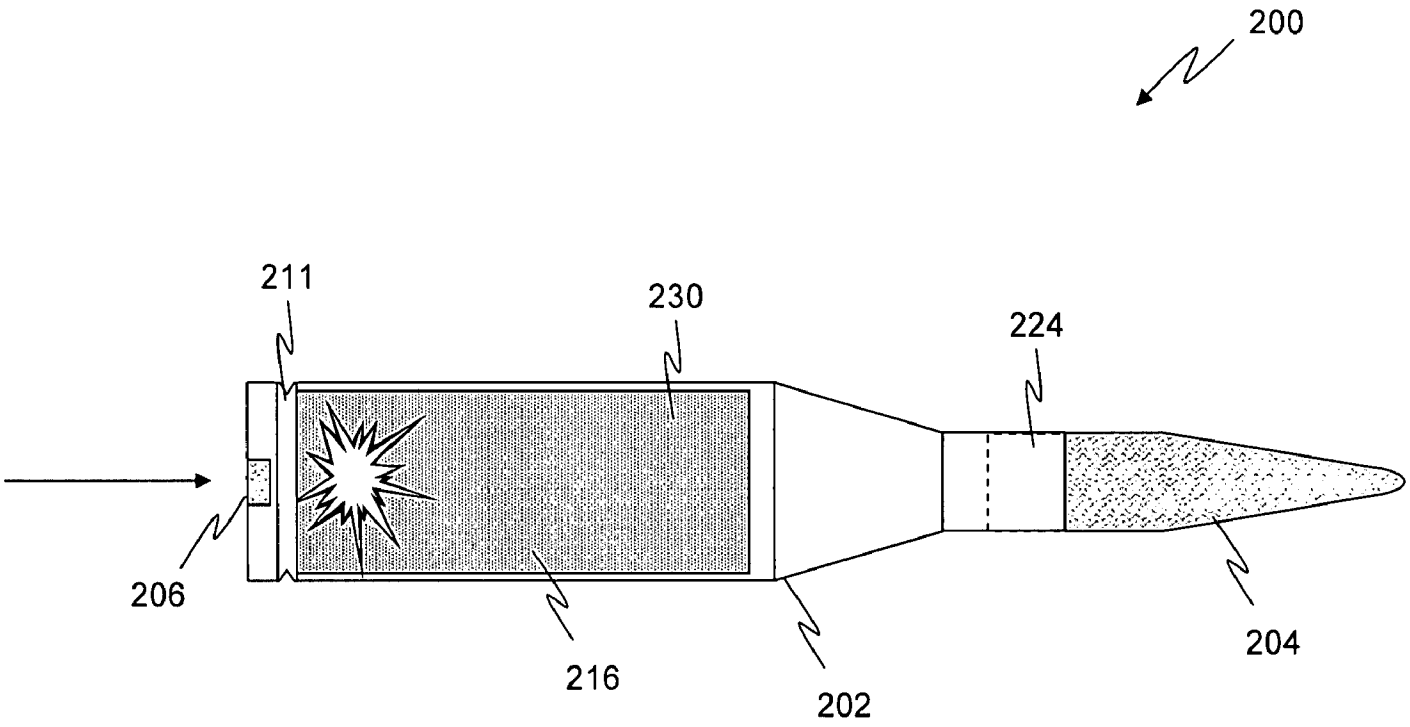
FIG. 8 is a side view of the improved 9 mm cartridge in FIG. 4 being fired.

Referring to FIG. 7 and FIG. 8, the bullet 204 may be frictionally associated with the cartridge case 202 via the top opening 218, wherein the bullet 204 is snugly and frictionally associated with the casing top portion 210 such that at least a portion of the bullet 204 is disposed within the casing top portion 210. It should be appreciated that the bullet 204 should be snugly associated with the cartridge case 202 such that the 45-9 cartridge 200 includes a predetermined cartridge length V which may be approximately equal to 1.275 inches. Additionally, the cap 206 may be non-movably associated with the casing bottom portion 214 via the bottom opening 220, wherein the bottom opening 220 is shown as being disposed in the center portion of the casing bottom portion 214. The casing cavity 216 may include a propellant 230 and the cap 206 may include a catalyst, such that interaction with the cap 206, such as by the firing mechanism of a firearm, causes the catalyst to interact with the propellant 230 disposed within the casing cavity 216, either directly or indirectly, to cause the bullet 204 to be propelled rapidly away from the cartridge case 202.

Figure 9:
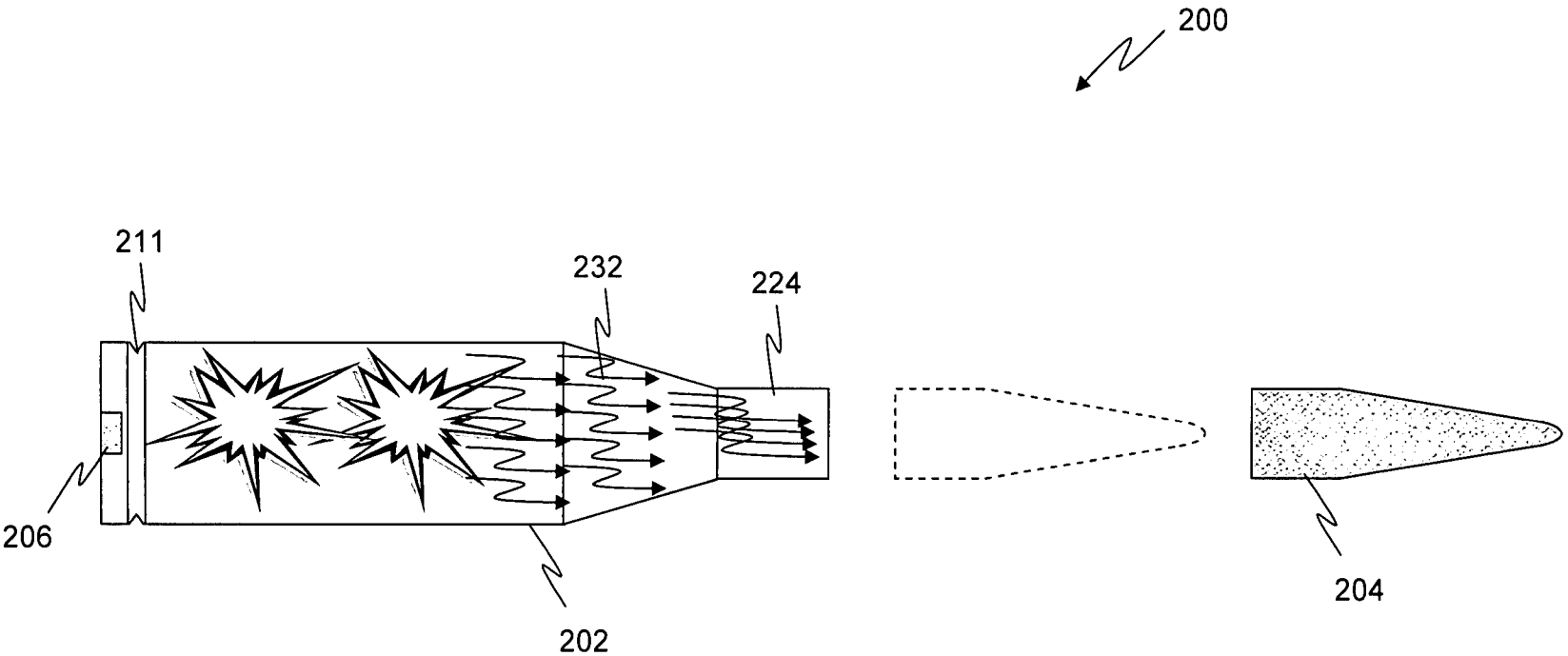
FIG. 9 is a side view of the improved 9 mm cartridge in FIG. 4 being fired.

For example, referring again to FIG. 8, the 45-9 cartridge 200 is shown and includes a cartridge case 202, a bullet 204 and a primer or cap 206 (such as a centerfire percussion cap), wherein the cap 206 includes a catalyst, such as a high explosive material and wherein the cartridge case 202 includes a propellant 230, such as gun powder, disposed within the casing cavity 216. The bullet 204 is snugly associated with the top opening 218 of the cartridge case 202 to sealingly enclose the casing cavity 216. When the percussion cap 206 is struck by the firing pin of a firearm, the catalyst in the cap 206 ignites, causing the propellant 230 contained within the casing cavity 216 to ignite. Referring to FIG. 9, as the propellant 230 contained within the casing cavity 216 ignites, gas pressure 232 is built up within the casing cavity 216 and pushes against the bullet 204 forcing the bullet 204 away from the cartridge case 202 at a high velocity and down the barrel of the firearm. It is contemplated that the bullet 204 may include any bullet suitable to the desired end purpose having a mass of at least 90 grains and configured for firing from a 9 mm firearm. Moreover, the casing cavity 216 should be sized to have a volume large enough to hold enough propellant 230 to propel the bullet 204 at a velocity of at least 1600 feet per second (fps).

It should be appreciated that this invention allows for a 9 mm bullet 204 having a mass of at least 90 grains to achieve a larger amount of kinetic energy (i.e. mass×velocity) than the 9 mm bullets (projectiles) currently in use. Upon impact of the bullet 204 with a target, this larger kinetic energy translates into increased penetration and/or greater stopping power (i.e. lethality) than current 9 mm bullets (projectiles). Moreover, this invention also allows for the bullet 204 to have a larger weight range and larger velocity range than current 9 mm bullets allowing for the weight and velocity of the bullet 204 to be adjusted for a particular use and/or situation. Furthermore, it should be appreciated that the bullet 204 may be propelled from the barrel of any firearm suitable to the desired end purpose of firing the 45-9 cartridge 200, including a 9 mm rifle, a 9 mm pistol, a 9 mm revolver and a 9 mm submachine gun.

It should be further appreciated that the cartridge case 202 may be constructed from any material or combination of materials suitable to the desired end purpose, such as brass, copper, zinc, steel, nickel. Furthermore, it should be appreciated that the bullet 204 may be constructed from any material or combination of materials suitable to the desired end purpose, such as lead, depleted Uranium, a copper alloy jacketed lead core material and/or any combination thereof.

Figure 10:
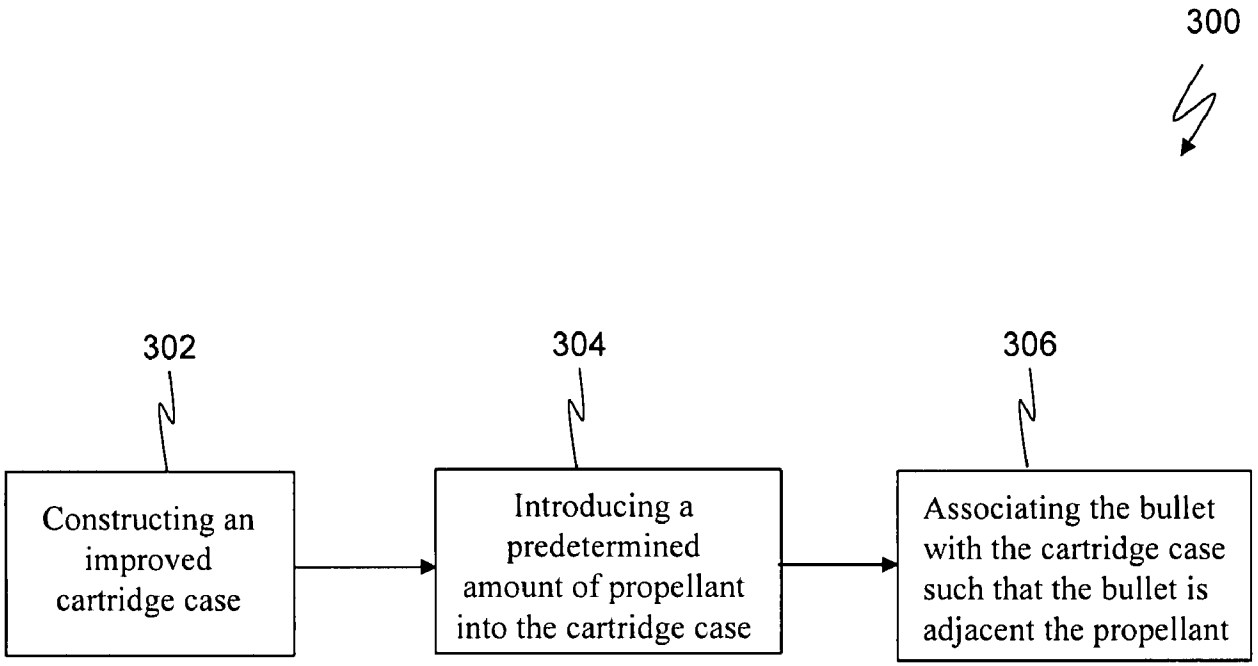
FIG. 10 is a block diagram illustrating a method for generating the improved 9 mm cartridge in FIG. 4.
Figure 11:
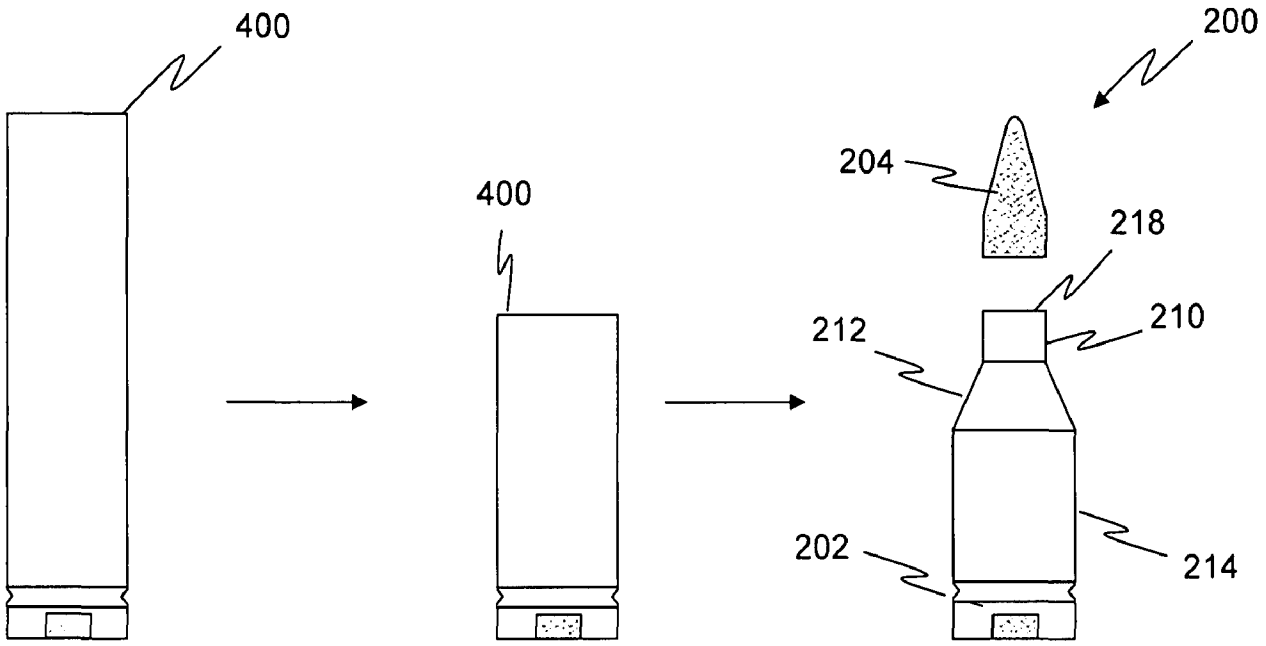
FIG. 11 is a side view of a .45 Winchester Magnum caliber cartridge being configured into the improved 9 mm cartridge in FIG. 4.
Figure 12:
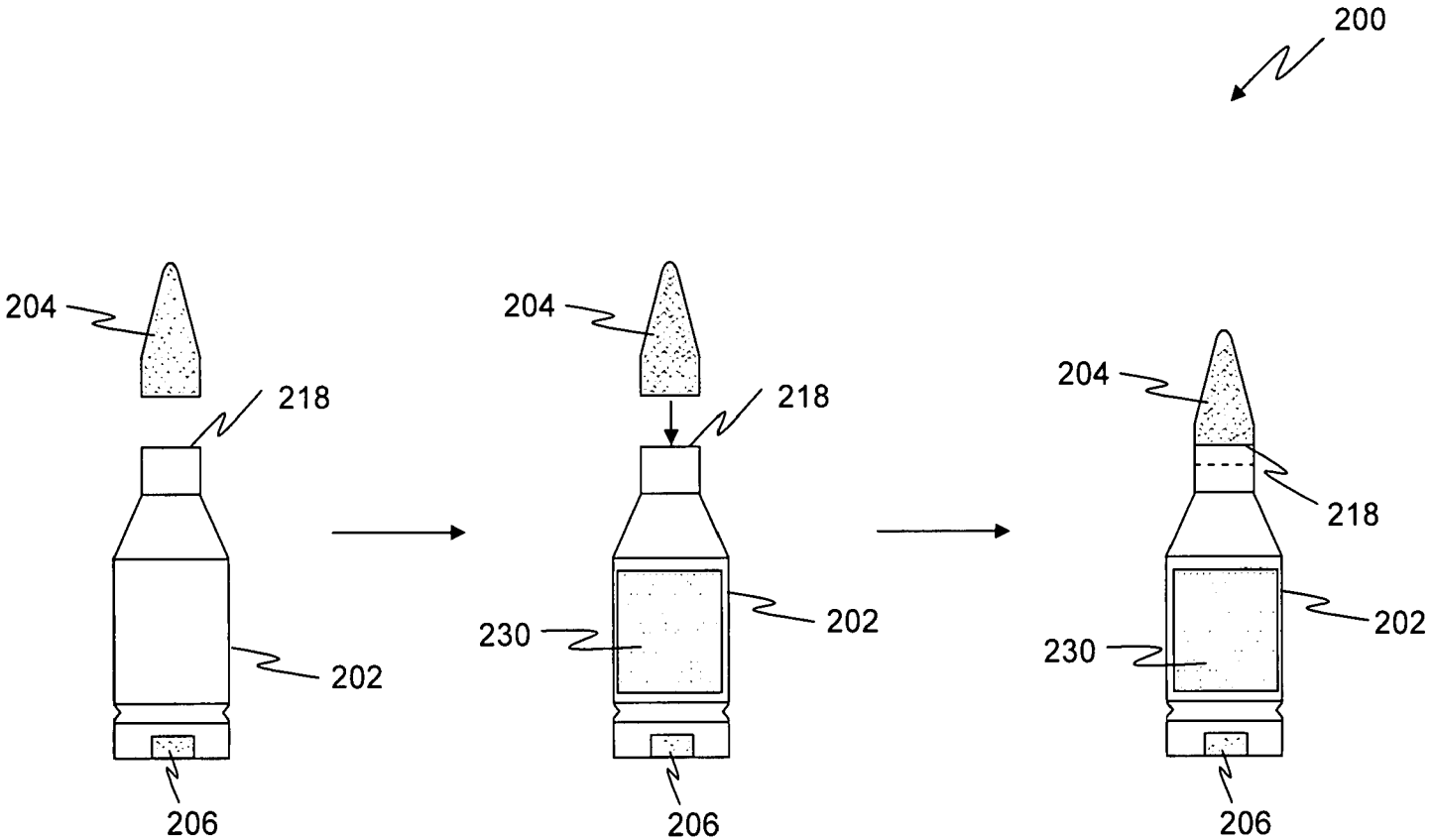
FIG. 12 is a side view of the improved 9 mm cartridge of FIG. 4 being generated using the improved 9 mm cartridge case in FIG. 5.

Referring to FIG. 10, a block diagram illustrating a method 300 for generating the 45-9 cartridge 200 is shown and includes constructing the cartridge case 202, as shown in operational block 302, wherein the cartridge case 202 includes the cap 206. This may be accomplished either by newly fabricating the cartridge case 202 or by modifying (i.e. cutting and necking down) the cartridge case of a 0.45 Winchester Magnum caliber cartridge 400 to achieve the dimensions of the cartridge case 202 as disclosed hereinabove and as shown in FIG. 11 and FIG. 12. The process of "cutting and necking down" involves physically resizing the length of the .45 Win Mag caliber cartridge case 400 by cutting or grinding away the case material disposed on the top portion of the .45 Win Mag caliber cartridge case 400 and resizing, or 'necking down,' the top portion .45 Win Mag caliber cartridge case 400 to form a casing top portion 210, a casing center portion 212 and a casing bottom portion 214 having the dimensions as discussed herein, wherein the casing top portion 210 is sized to securingly contain the 9 mm diameter bullet 204 while the casing bottom portion 214 is kept at the original size of the .45 Win Mag Case 400.

The method 300 also includes introducing a predetermined amount of propellant 230 into the casing cavity 216, as shown in operational block 304. It should be appreciated that the amount of propellant 230 to be used with the bullet 204 may be varied in a manner responsive to the mass of the bullet 204 and the desired projectile velocity, wherein the amount of propellant 230 used should be sufficiently large to propel the bullet 204 to a velocity of at least 1600 feet per second (fps). Furthermore, the method includes associating the bullet 204 with the cartridge case 202, as shown in operational block 306, such that at least a portion of the bullet 204 is contained within the casing cavity 216. This may be accomplished via any method/device suitable to the desired end purpose, such as by compressing the bullet 204 into the top opening 218. It should be appreciated that although the bullet 204 may have a mass of at least 90 grains, the 9 mm diameter of the bullet 204 should remain unchanged.

Figure 13:
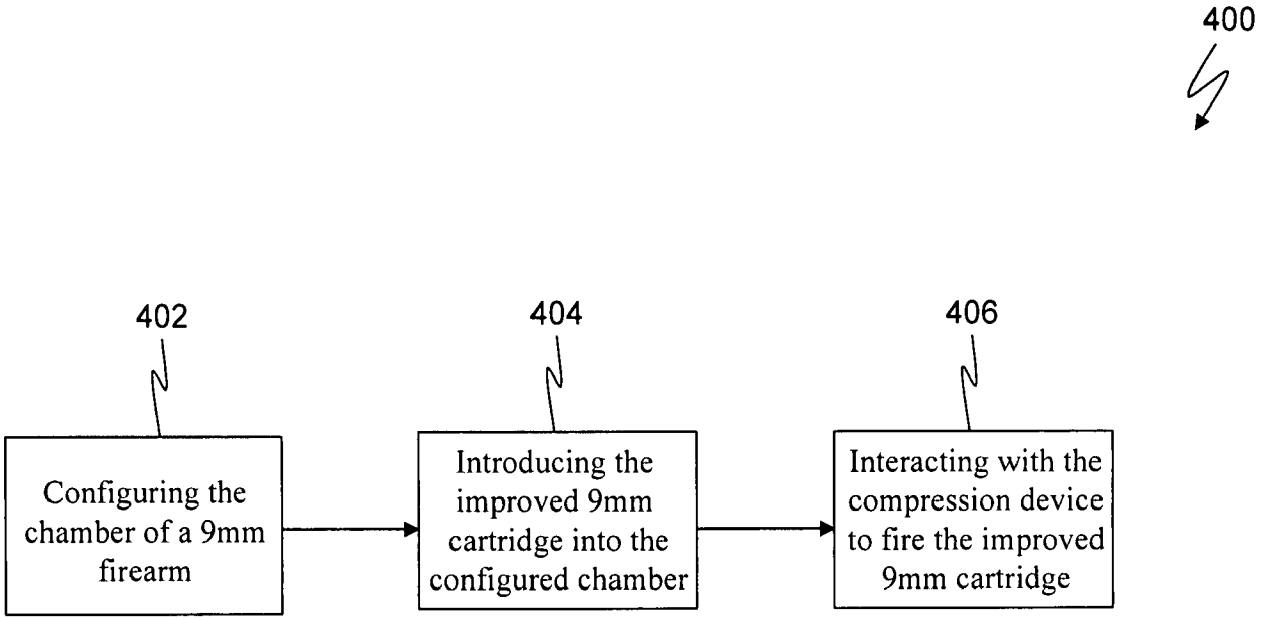
FIG. 13 is a block diagram illustrating a method for implementing the improved 9 mm cartridge in FIG. 4.
Figure 14:
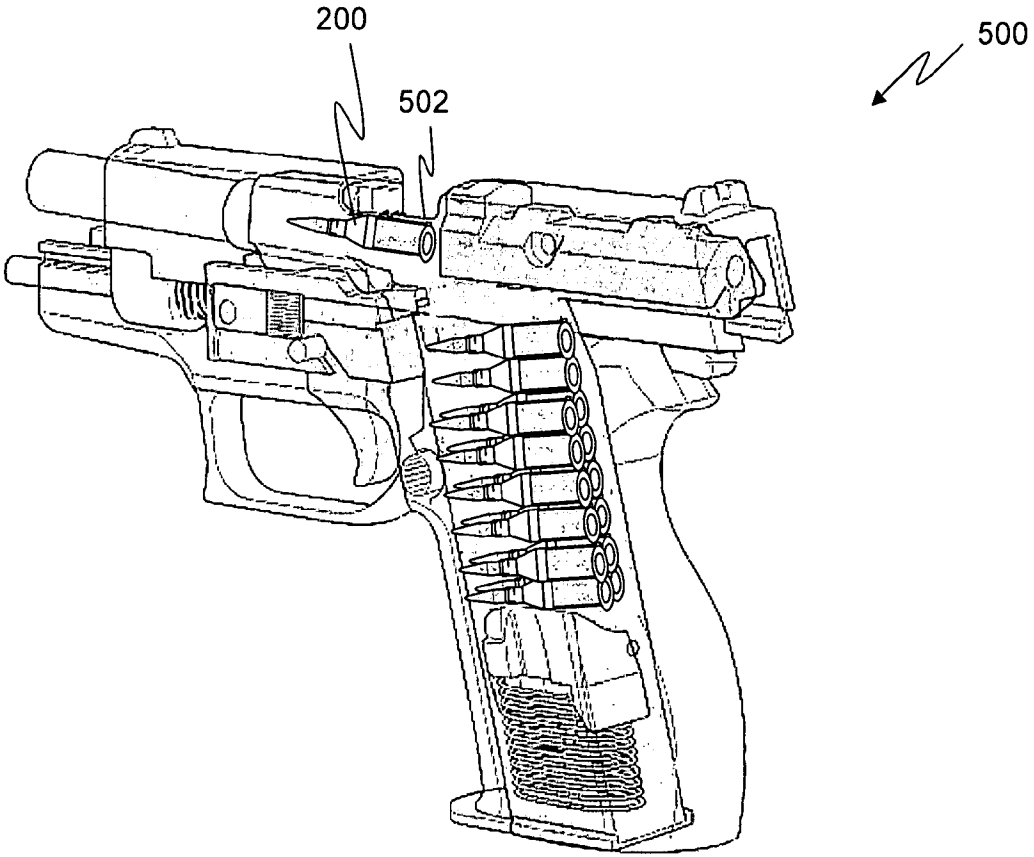
FIG. 14 is a side cross-sectional perspective view of a 9 mm firearm configured to interact with the improved 9 mm cartridge in FIG. 4.
Figure 15:
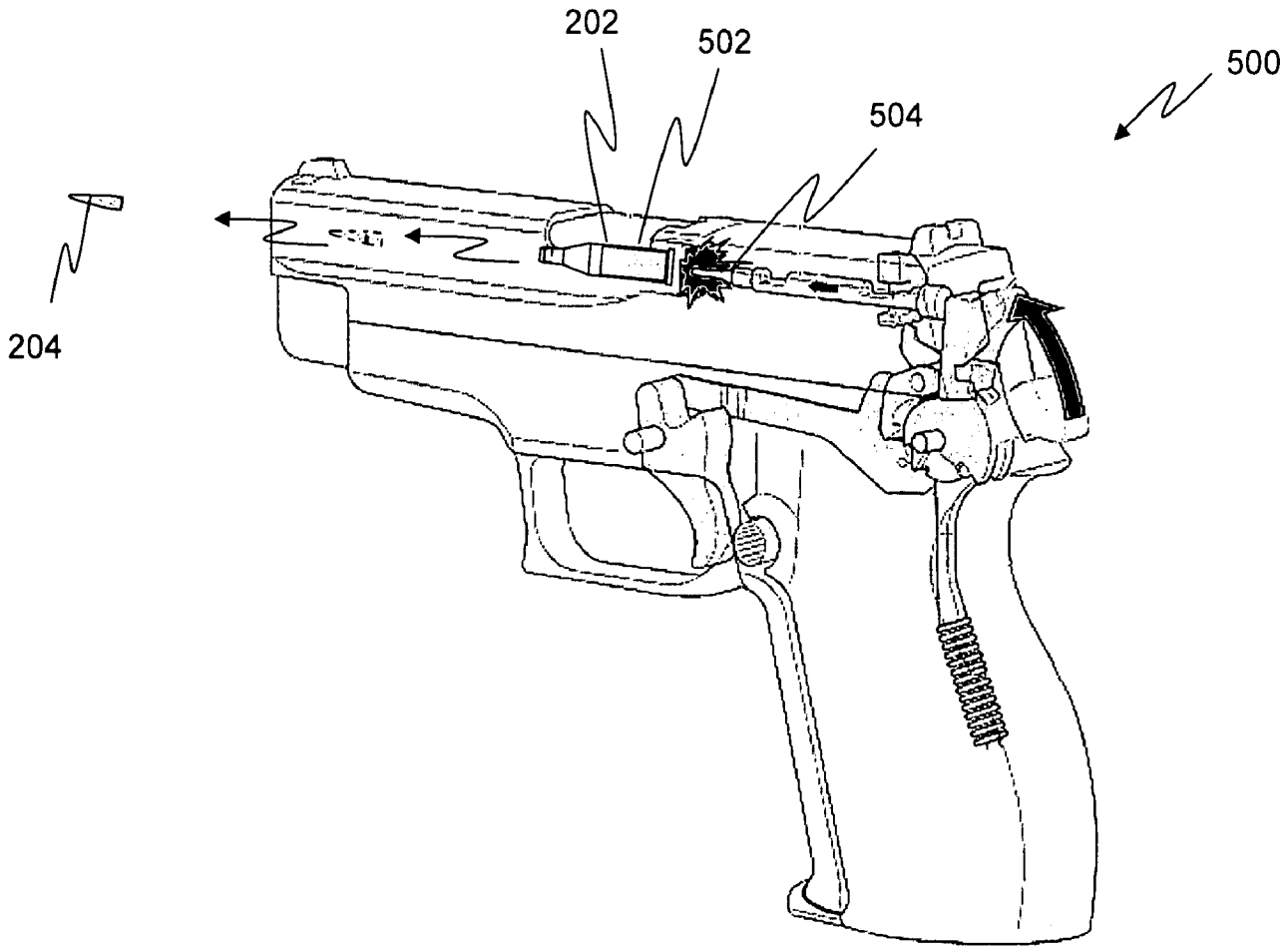
FIG. 15 is a side cross-sectional perspective view of a 9 mm firearm configured to interact with the improved 9 mm cartridge in FIG. 4.

Referring to FIG. 13, a block diagram describing a method 400 for implementing the 45-9 cartridge 200 is illustrated and includes configuring the chamber 502 of a 9 mm firearm 500 to hold the 45-9 cartridge 200, as shown in operational block 402. This may be accomplished by boring out or resizing the chamber 502 of the 9 mm firearm 500 via any method and/or device suitable to the desired end purpose, to operatively accommodate the casing of a 45-9 cartridge. Referring to FIG. 14, the 45-9 cartridge 200 may then be introduced into the chamber 502 of the 9 mm firearm 500 such that the cap 206 is disposed adjacent the firing pin 504, as shown in operational block 404. The 45-9 cartridge 200 may then be fired using the 9 mm firearm 500 by interacting with a compression device or trigger 506 of the 9 mm firearm 500, causing the firing pin 504 to strike the cap 206 of the 45-9 cartridge 200, as shown in FIG. 15 and operational block 406.

Figure 16:
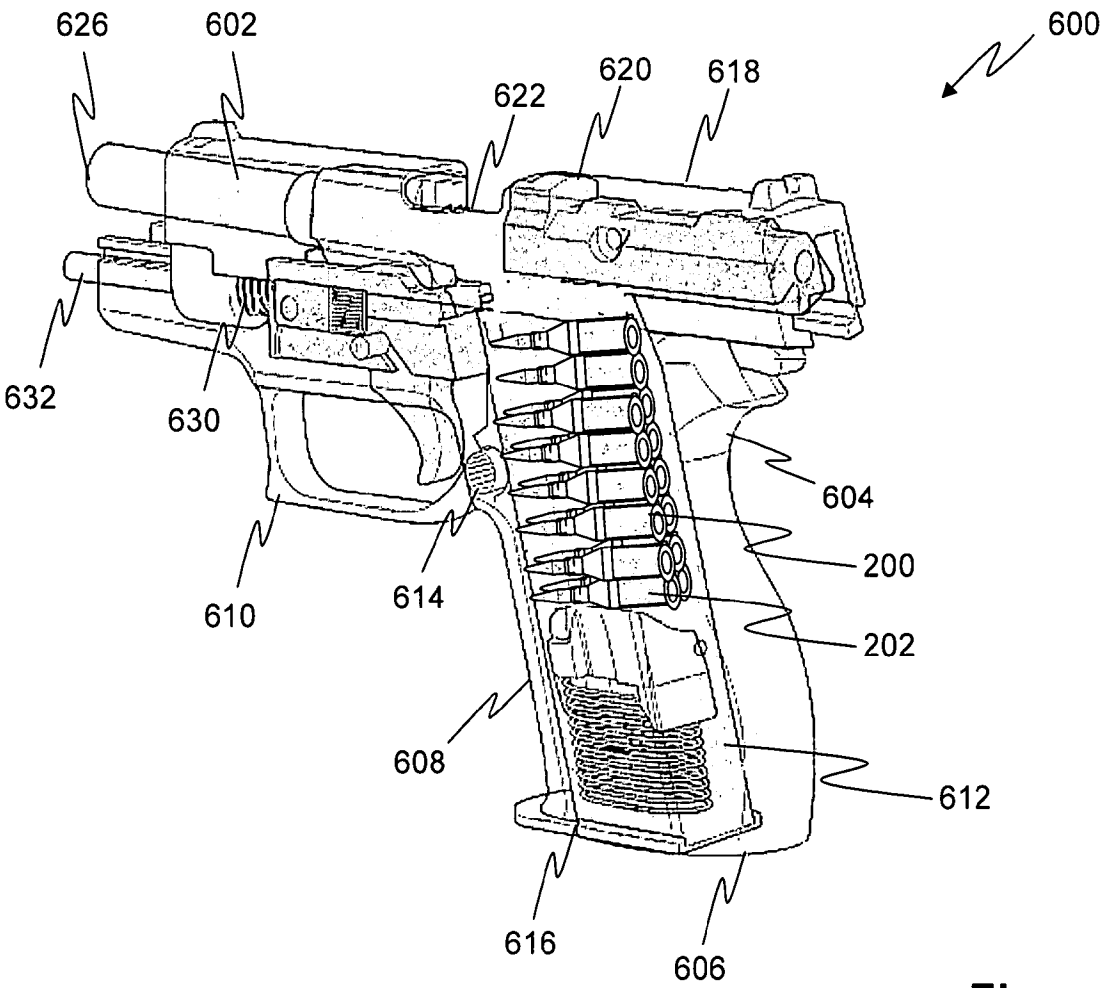
FIG. 16 is a side cross-sectional perspective view of a firearm configured to interact with the improved 45-9 cartridge in FIG. 4.
Figure 17:
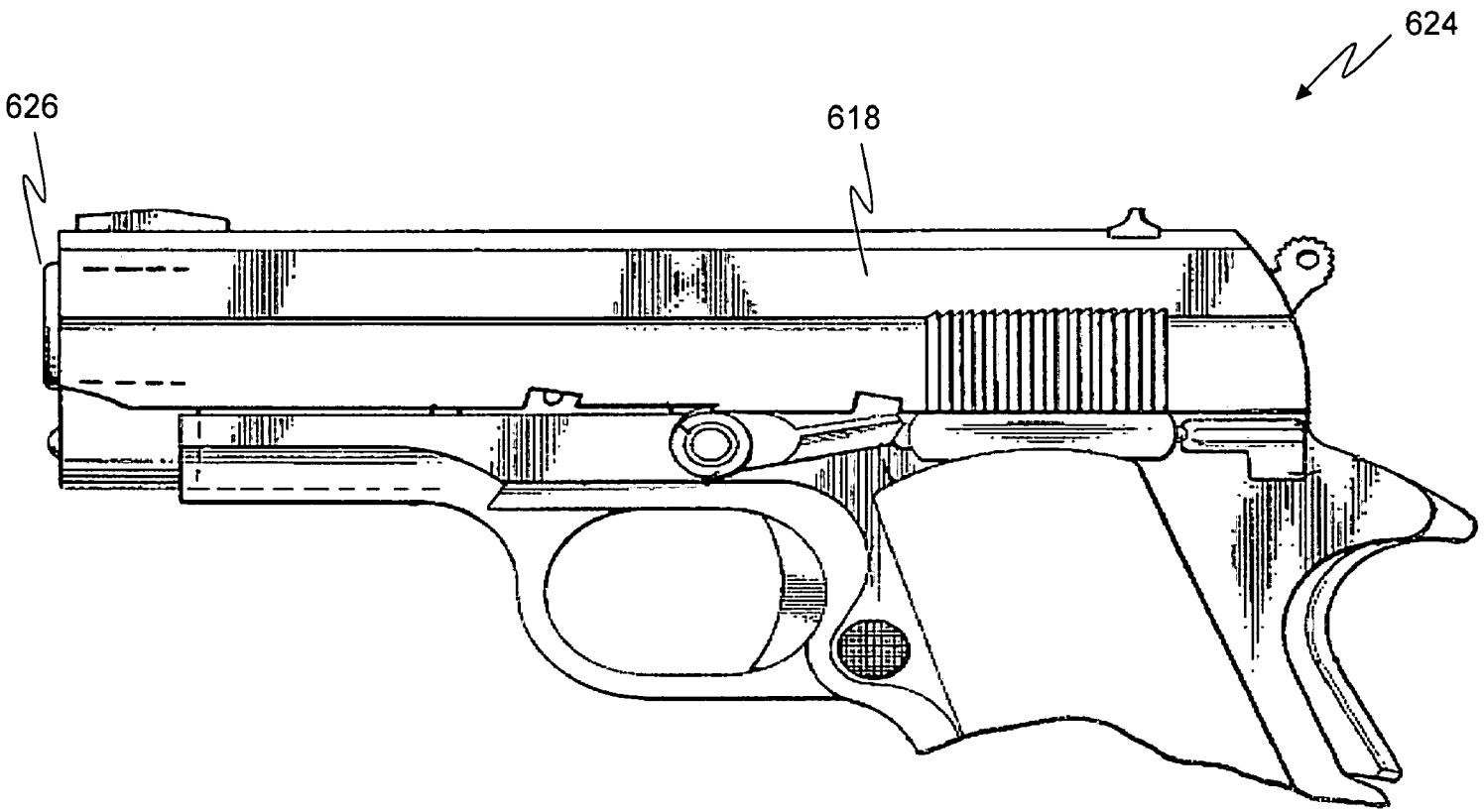
FIG. 17 is a side view of a firearm configured to interact with the improved 45-9 cartridge in FIG. 4.
Figure 18:
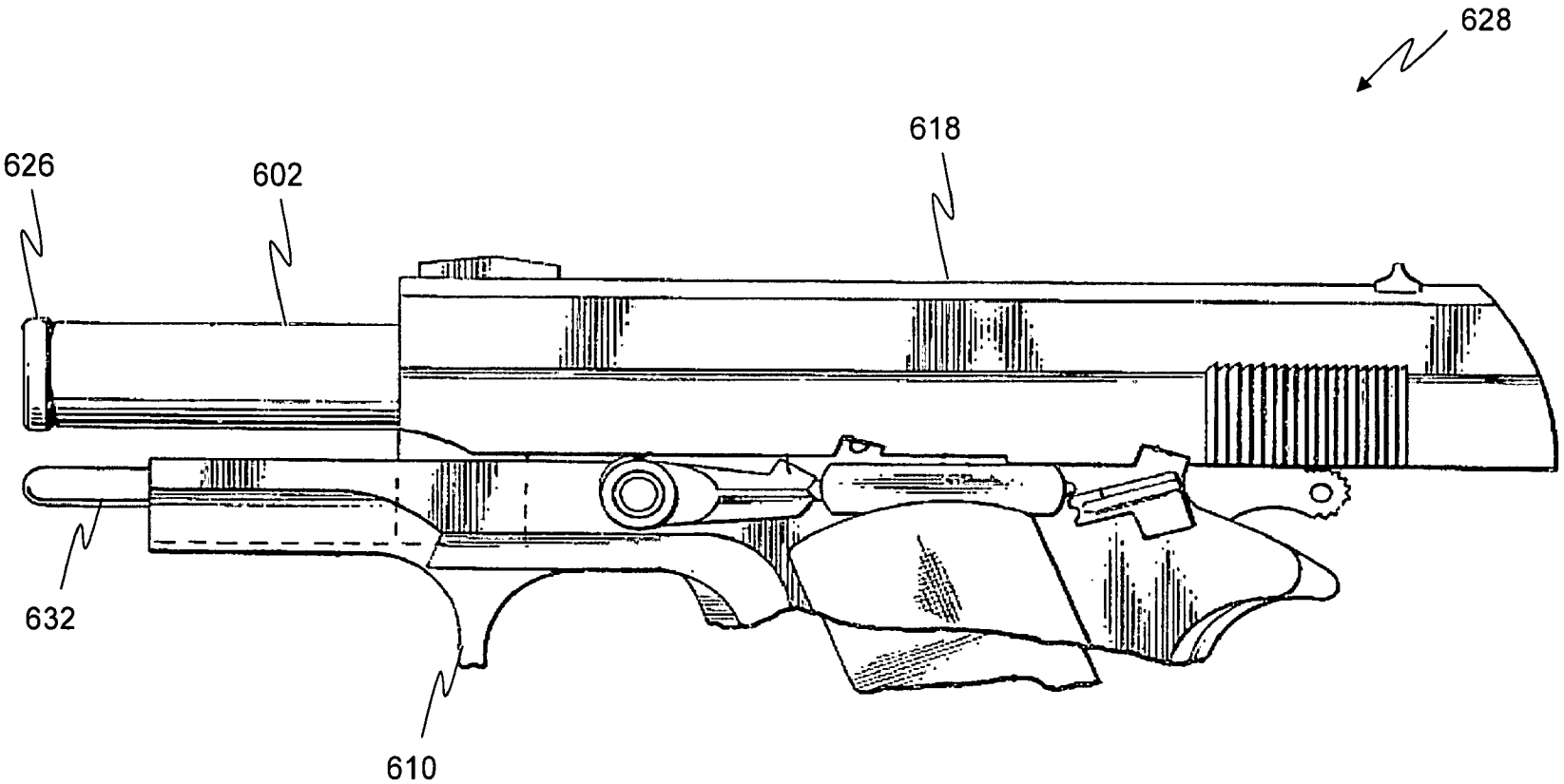
FIG. 18 is a side view of a firearm configured to interact with the improved 45-9 cartridge in FIG. 4.

Referring to FIG. 16, FIG. 17 and FIG. 18, one embodiment of a firearm 600 capable of operation using a 45-9 cartridge 200 is shown. The handgun 600 includes an improved barrel 602 fixed to a frame 604, wherein the frame 604 includes a handle 606 having a gripping portion 608 and a trigger housing/guard 610. The handle 606 may be adapted to receive a magazine 612 containing a plurality of 45-9 cartridges 200 and may also include a magazine release button 614 to release the magazine 612 from the handle 606 via a receiver 616. The firearm 600 may use a typical conventional firing means, such as a striker or hammer mounted on the rear portion of the frame 604 and a more or less standard trigger bar, sear, and release mechanism. The construction and operation of all of these elements are well known in the art and should require no further elaboration.

Figure 19:
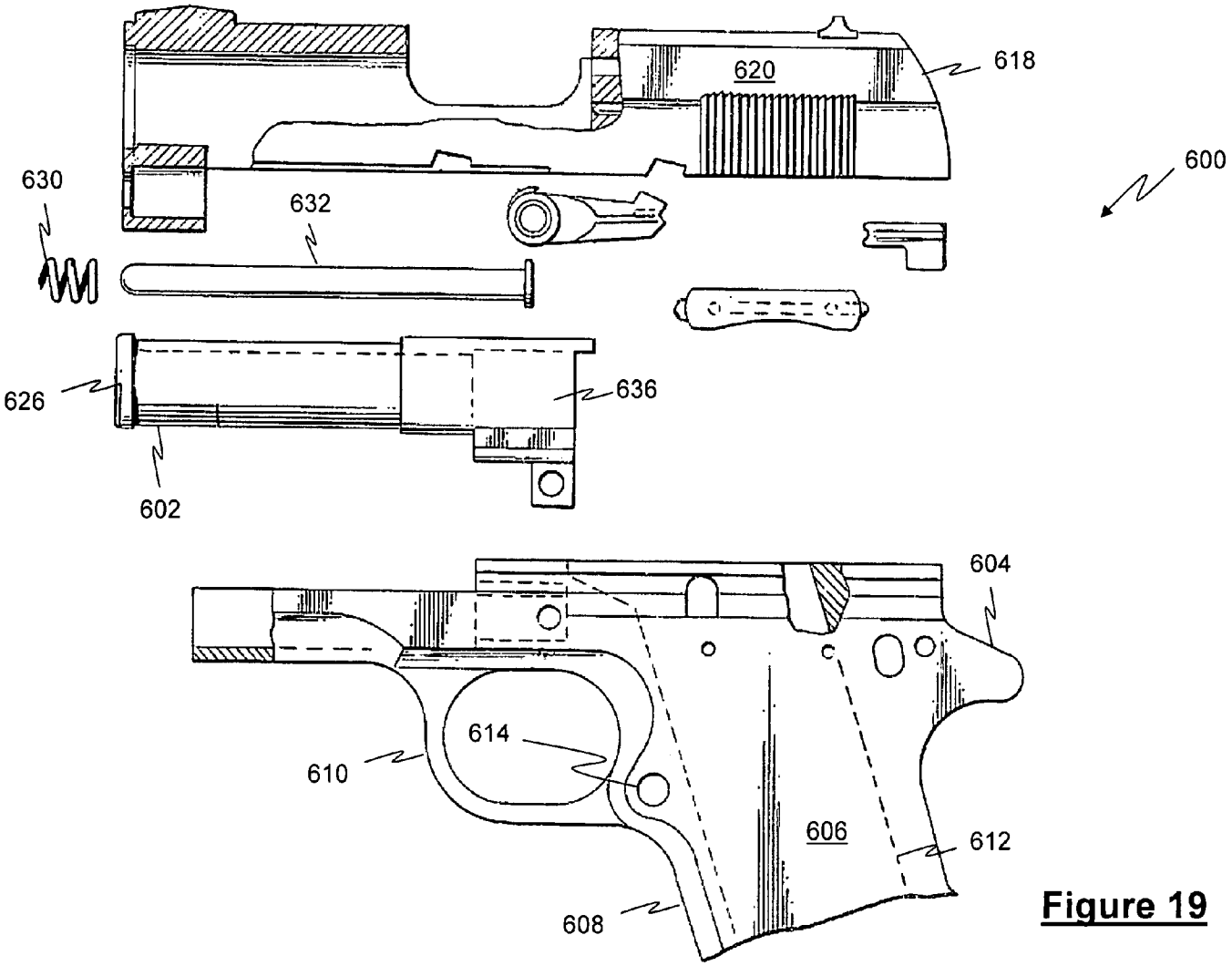
FIG. 19 is an exploded side view of a firearm configured to interact with the improved 45-9 cartridge in FIG. 4.

The firearm 600 may also include a slide portion 618 having a conventional breech block 620 with a face associated with a firing chamber 622, wherein the face is adapted to abut the base of the 45-9 cartridge case 202 when the 45-9 cartridge case 202 is seated in the firing chamber 622 of the improved barrel 602. It should be appreciated that as is well known, a standard firing pin and a cartridge case extractor may be provided and may extend through the face of the breech block 620. Also, as is well known in conventional magazine-fed firearms of this type, the slide portion 618 may travel between a forward-most or battery position 624, as shown in FIG. 17, in which the breech block 620 is in tight abutment with the 45-9 cartridge case 202 seated in the firing chamber 622, such that only an interior portion 626 of the barrel 602 is exposed, and a rearward-most or full-recoil position 628, as shown in FIG. 18. A recoil spring 630 is typically provided and may be carried on a recoil spring guide 632 extending rigidly from the frame 604 below the improved barrel 602, wherein the recoil spring 630 acts between the frame 604 and the slide portion 618 to urge the latter from the full-recoil position 628 into the battery position 624. It should be appreciated that the firearm 600 may be configured such that the firing chamber 622 is configured to at least partially contain the 45-9 cartridge case 202 and the improved barrel 602 is configured to operably associate with the 9 mm bullet 204. FIG. 19 illustrates an exploded view of the major parts of the firearm 600.

Figure 20:
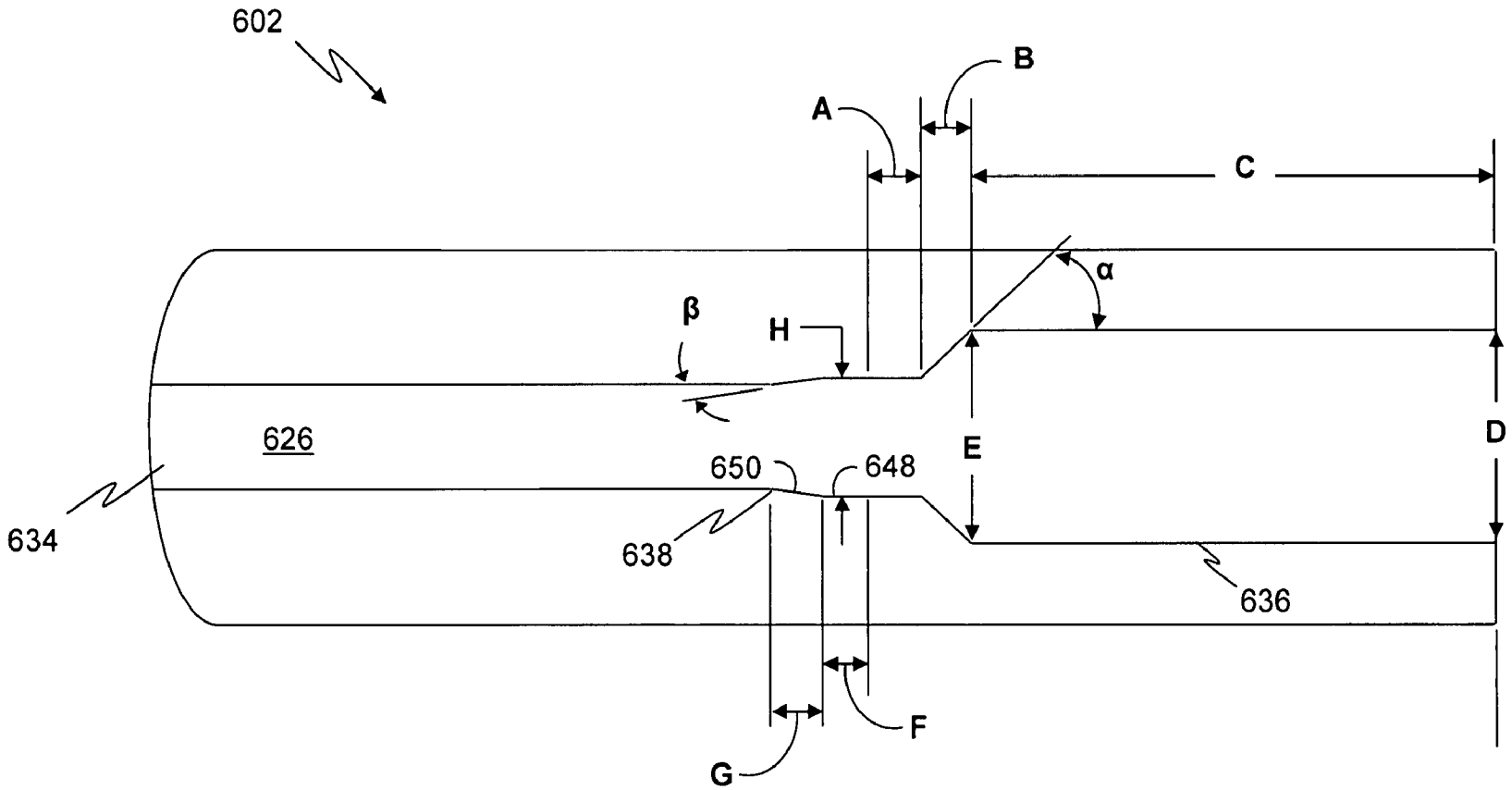
FIG. 20 is a cross sectional side view of the barrel of a firearm configured to interact with the improved 45-9 cartridge in FIG. 4.
Figure 21A:
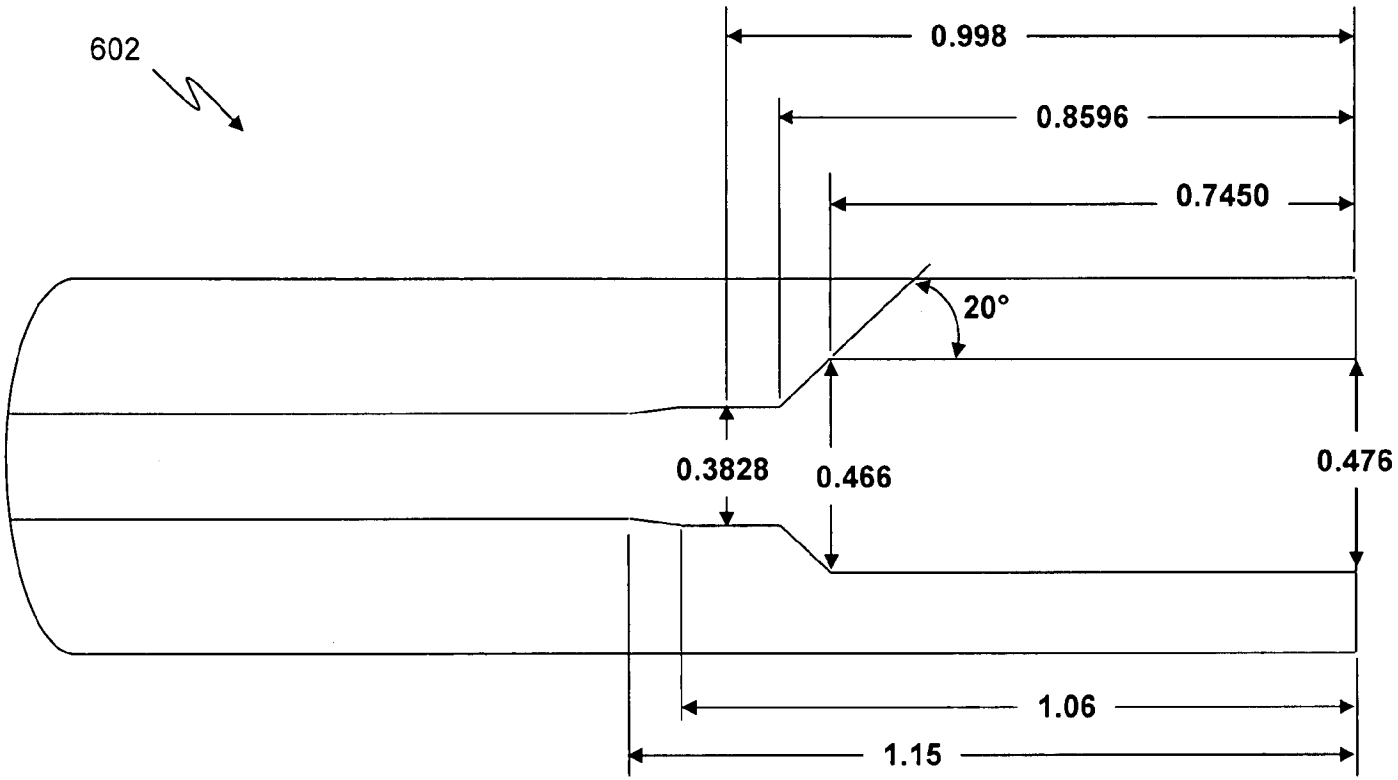
FIG. 21*a* is a cross sectional side view of the barrel of a firearm configured to interact with the improved 45-9 cartridge in FIG. 4.
Figure 21B:
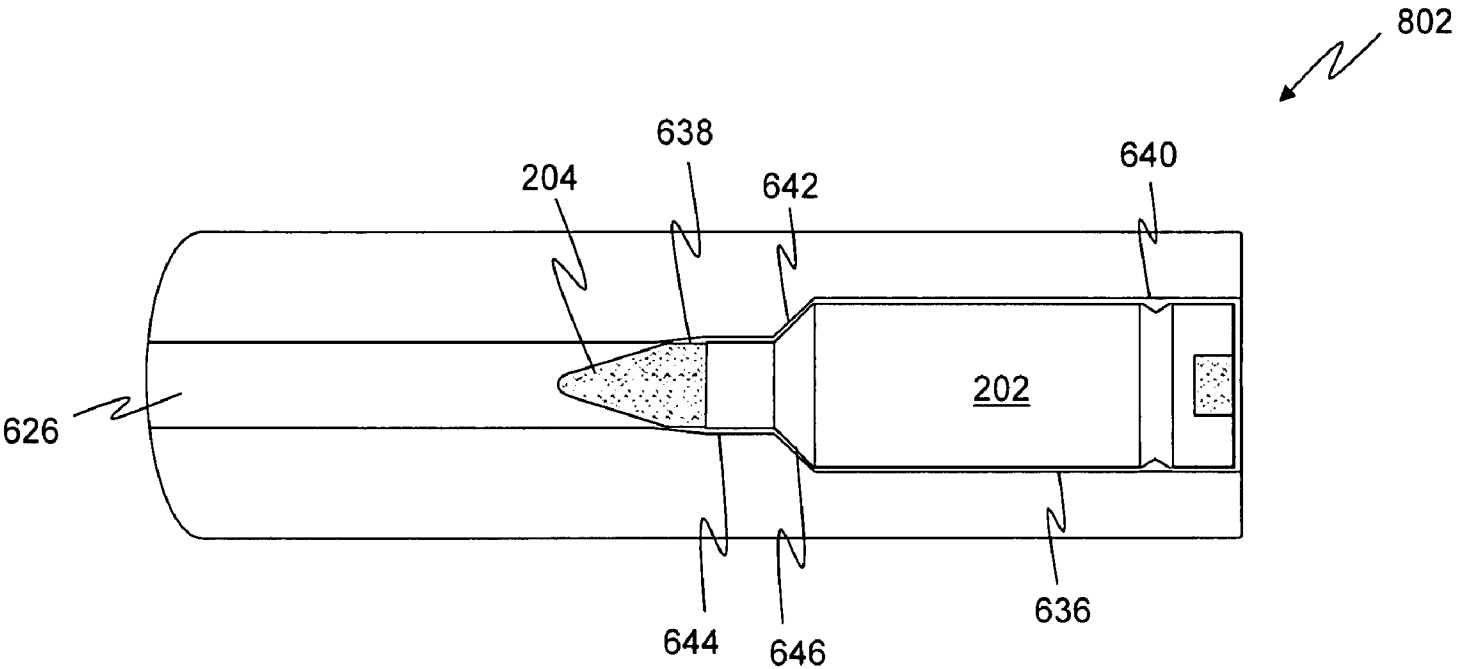
FIG. 21*b* is a cross sectional side view of the barrel of a firearm configured to interact with the improved 45-9 cartridge in FIG. 4.

Referring to FIG. 20, a cross-sectional view of the improved barrel 602 is shown wherein the improved barrel 602 defines a barrel cavity 634 which typically includes a chamber portion 636, a free-bore portion 638 and the interior portion 626, wherein the chamber portion 636 is sized and shaped to at least partially contain the 45-9 cartridge case 202 such that the bullet 204 is at least partially disposed within the free-bore portion 638. The barrel cavity 634 is sized such that the interior portion 626 has a land diameter of 0.3460 inches and a groove diameter of 0.3550 inches to receive and operationally interact with the bullet 204 when the cartridge 202 has been fired. Referring to FIG. 20, FIG. 21*a* and FIG. 21*b*, the chamber portion 636 includes a first chamber portion 640, a second chamber portion 642 and a third chamber portion 644, wherein the first chamber portion 640 includes a first chamber portion length C equal to about 0.7450 inches and a first chamber portion width E equal to about 0.466 inches. The second chamber portion 642 includes a second chamber portion length B equal to about 0.1146 inches and includes a second chamber portion wall 646 which is angled at an angle $\alpha°$ which may be about 20° from horizontal such that the width E of the second chamber portion 642 reduces from about 0.4660 inches to about 0.3828 inches. The third chamber portion 644 includes a third chamber portion length A equal to about 0.1384 inches and a third chamber portion width H equal to about 0.3828 inches.

It should be appreciated that the first chamber portion 640 includes a first predetermined tolerance range, the second chamber portion 642 includes a second predetermined tolerance range and the third chamber portion 644 includes a third predetermined tolerance range, wherein at least one of the first predetermined tolerance range, the second predetermined tolerance range and the third predetermined tolerance range is equal to about ±10%.

As is known, the free-bore portion 638 is disposed to be between the chamber portion 636 and the interior portion 626, such that the free-bore portion 638 is just short of and/or adjacent to the portion of the improved barrel 602 where the rifling begins (i.e. interior portion 626). One reason for this is that a cartridge would typically not be able to be chambered without an area just forward of the chamber portion 636 to accommodate the projectile or bullet 204 when the cartridge 202 is disposed within the chamber portion 636. It should be appreciated that typically the free-bore portion 638 ends right at the tip of the bullet 204, and once fired, the bullet 204 "jumps" into the rifled interior portion 626 to interact with the rifling of the bore interior portion 626. However, some guns have a longer free-bore portion 638 than others, depending on the manufacturer or the particular school of thought.

A longer free-bore portion 638 would allow cartridges having different weights and/or projectile shapes to be chambered without contacting the rifling of the bore interior portion 626. Additionally, if desired, the diameter of the free-bore portion 638 may be tapered. The free-bore portion 638, as shown in FIG. 20 and/or FIG. 21, includes a first free-bore portion 648 and a second free-bore portion 650, wherein the second free-bore portion 650 may include a taper (in this case a taper of about 1°-2° is shown) from horizontal. The first free-bore portion 648 includes a first free-bore portion length F equal to about 0.062 inches and the second free-bore portion 650 includes a second free-bore portion length G equal to about 0.09 inches. It should be appreciated that a tapered free-bore portion 638 and/or a longer free-bore portion 638 than is shown may be used and would vary depending on at least one characteristic of the bullet 204, such as the size, shape and/or weight of the bullet 204.

Figure 22:
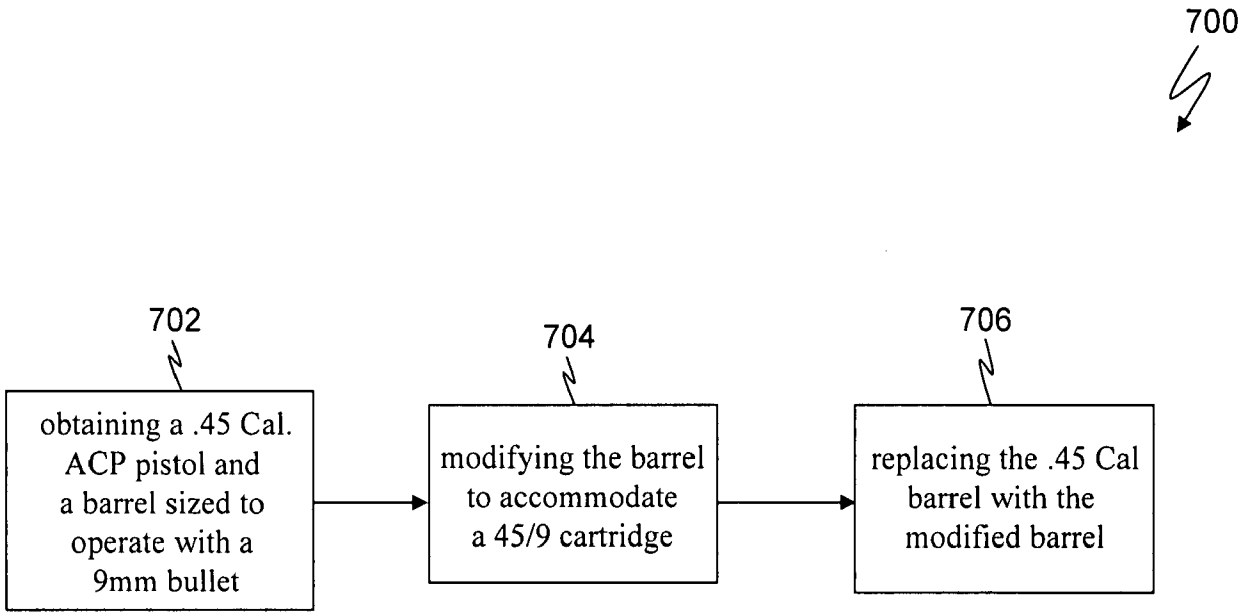
FIG. 22 is a block diagram illustrating a method for creating a handgun which operates with the 45-9 cartridge in FIG. 4.

In accordance with the present invention, a block diagram illustrating one embodiment of a method 700 for creating the firearm 600 is shown in FIG. 22 and involves modifying an existing firearm to accommodate the 45-9 cartridge 200. Referring to FIG. 18, the method 700 includes obtaining a .45 Caliber ACP pistol and a second barrel, wherein the second barrel is sized to operate with a 9 mm bullet and includes a 9 mm interior portion, a 9 mm free-bore portion and a 9 mm chamber portion, as shown in operational block 702. The second barrel is then modified to accommodate the 45-9 cartridge 200, as shown in operational block 704. This may be accomplished by adjusting the configuration of the 9 mm free-bore portion and/or the 9 mm chamber portion to obtain the improved barrel 602 having predetermined dimensions as discussed hereinbefore which allow operation with the 45-9 cartridge 200, wherein these predetermined dimensions are discussed in greater detail hereinbefore. The 9 mm free-bore portion and/or the 9 mm chamber portion of the barrel may be reamed to obtain the improved barrel 602 having the chamber portion 636 and the free-bore portion 638 as shown in FIG. 20 such that the modified barrel can operably accommodate the 45-9 cartridge 200. The .45 Caliber barrel may then be replaced with the improved barrel 602, as shown in operational block 706.

It should be appreciated that each of the size/diameter dimensions described hereinabove are subject to a predetermined tolerance range of values, wherein the predetermined tolerance range of values may be between about ±0.004 inches. Additionally, it should be appreciated that the angle $\beta$ is subject to a predetermined tolerance angle range, wherein the predetermined tolerance angle range may be between about ±2°. Moreover, although the firearm of the present invention is disclosed herein as being associated with a 45-9 cartridge 200 constructed from a 45 Caliber Win Mag cartridge, the firearm of the present invention may be associated with a 45-9 cartridge 200 constructed from any type of cartridge as well as a 45-9 cartridge 200 constructed from raw materials. Furthermore, although the invention is disclosed herein in terms of an automatic firearm, it is also contemplated that revolvers that are configured to operable associate with the 45-9 cartridge 200 also fall within the scope of the present invention.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A firearm for implementing an improved 9 mm cartridge having a 9 mm bullet and a cartridge casing, the firearm comprising:

a barrel, wherein the barrel is configured to operably interact with a 9 mm bullet;

a chamber, wherein the chamber includes at least one chamber portion sized and shaped to operably associate with a .45 caliber cartridge casing, wherein the .45 caliber cartridge casing has a length approximately equal to 0.9880 inches and wherein the length may vary by a tolerance range of approximately ±0.004 inches; and a free-bore, wherein the free-bore includes a first free-bore portion having a first free-bore portion diameter and a second free-bore portion having a second free-bore portion diameter, wherein the second free-bore portion includes a second free-bore portion wall that is tapered between about 1° to about 2° such that the second free-bore portion diameter is smaller than the first free-bore portion diameter, and wherein the free-bore sized and shaped to operably associate with at least a portion of the cartridge casing and the 9 mm bullet, and wherein the 9 mm bullet weights at least 90 grains and is configured for operation with a 9 mm firearm, and the .45 caliber cartridge casing is configured to operate with a .45 caliber firearm, the .45 caliber cartridge casing having a case bottom portion communicated with a case top portion via a case middle portion having a length that is approximately equal to 0.0236 inches and tapered at an angle of 20 degrees relative to a plane disposed parallel to said case bottom portion, wherein said angle may vary by a tolerance range of approximately ±2 degrees, wherein the case bottom portion, the case middle portion and the case top portion define a case cavity and wherein the case top portion includes a top opening communicated with the case cavity, the top opening sized to interact with the 9 mm bullet, wherein the 9 mm bullet is frictionally associated with the top opening such that at least a portion of the 9 mm bullet is disposed within the case cavity, a means for propelling the 9 mm bullet to a velocity of at least 1600 feet per second, wherein the means for propelling is at least partially disposed within the casing cavity, and a cap, wherein the cap is associated with the case bottom portion such that when the cap is engaged, the cap causes the means for propelling the 9 mm bullet to propellingly interact with the 9 mm bullet.

2. The firearm of claim 1, wherein said at least one chamber portion includes a first chamber portion having a first chamber portion length equal to about 0.7450 inches and a first chamber portion width equal to about 0.4660 inches.

3. The firearm of claim 1, wherein said at least one chamber portion includes a second chamber portion having a second chamber portion length equal to about 0.1146 inches and a second chamber portion width, wherein said second chamber portion width decreases from about 0.4660 inches to 0.3828 inches.

4. The firearm of claim 1, wherein said at least one chamber portion includes a third chamber portion having a third chamber portion length equal to about 0.1384 inches and a third chamber portion width equal to about 0.3828 inches.

5. The firearm of claim 1, wherein the free-bore includes a free-bore length equal to about 0.1520 inches.

6. The firearm of claim 1, wherein the first free-bore portion diameter is equal to about 0.3828 inches.

7. The firearm of claim 1, wherein the second free-bore portion diameter is tapered from a second free-bore diameter of about 0.3828 inches to a second free-bore diameter of about 0.3550 inches.

8. The firearm of claim 1, wherein said at least one chamber portion includes at least one of a first chamber portion having a first predetermined tolerance range, a second chamber portion having a second predetermined tolerance range and a third chamber portion having a third predetermined tolerance range.

9. The firearm of claim 8, wherein at least one of said first predetermined tolerance range, said second predetermined tolerance range and said third predetermined tolerance range is equal to about ±10%.

* * * * *